US007763101B2

(12) United States Patent
Maekawa et al.

(10) Patent No.: US 7,763,101 B2
(45) Date of Patent: Jul. 27, 2010

(54) WATER-FLOWING MECHANISM OF WET TYPE ELECTROSTATIC PRECIPITATOR

(75) Inventors: Sachio Maekawa, Tokyo (JP); Mitsuaki Yanagida, Tokyo (JP); Shinichi Kawabata, Tokyo (JP); Keigo Orita, Tokyo (JP); Yoshihiko Mochizuki, Tokyo (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 253 days.

(21) Appl. No.: 12/073,016

(22) Filed: Feb. 28, 2008

(65) Prior Publication Data

US 2008/0216659 A1 Sep. 11, 2008

(30) Foreign Application Priority Data

Mar. 5, 2007 (JP) ..... 2007-054704

(51) Int. Cl.
*B03C 3/78* (2006.01)

(52) U.S. Cl. ..... 96/44; 95/75; 96/45; 96/50; 261/110; 261/112.1

(58) Field of Classification Search ..... 96/43–45, 96/47, 50, 52, 53; 95/75; 261/103, 106, 261/110, 112.1, 112.2
See application file for complete search history.

(56) References Cited

U.S. PATENT DOCUMENTS 1,888,022 A * 11/1932 Wintermute et al. ..... 96/45
2,563,297 A * 8/1951 Wilson ..... 96/25
3,742,681 A * 7/1973 deSeversky ..... 96/45
3,785,125 A * 1/1974 DeSeversky ..... 96/45
3,820,353 A * 6/1974 Shiraishi et al. ..... 62/305
3,856,476 A * 12/1974 De Seversky ..... 422/111
4,189,308 A * 2/1980 Feldman ..... 95/75
4,360,366 A * 11/1982 Collins et al. ..... 96/45
4,379,712 A * 4/1983 Sperr et al. ..... 96/294
4,499,031 A * 2/1985 Sexton et al. ..... 261/66
5,160,510 A * 11/1992 Steinbacher et al. ..... 95/64
2003/0200869 A1* 10/2003 Brock ..... 96/52
2003/0217642 A1* 11/2003 Pasic et al. ..... 96/44

FOREIGN PATENT DOCUMENTS

JP 6-47310 A * 2/1994 ..... 96/45
JP A 2001-190982 7/2001
JP A 2002-224588 8/2002

* cited by examiner

*Primary Examiner*—Richard L Chiesa
(74) *Attorney, Agent, or Firm*—Oliff & Berridge, PLC

(57) ABSTRACT

The present invention provides a water-flowing mechanism in a wet type electrostatic precipitator that can stably and quickly form a water film on a dust-collecting plate even at the beginning of the operation and that has an excellent adjusting function of a supplying flow-rate of washing liquid. The present invention includes a dust-collecting plate, a washing liquid supplying source to wet the dust-collecting plate, and a cylindrical member that is opened according to the shape of the upper end face of the dust-collecting plate and into which the washing liquid supplying source is inserted, wherein the horizontal cross-section of the dust-collecting plate is formed in a corrugated shape, and the lower opening of the cylindrical member is formed in a corrugated shape according to the dust-collecting plate.

12 Claims, 14 Drawing Sheets

WATER-FLOWING MECHANISM OF WET TYPE ELECTROSTATIC PRECIPITATOR

BACKGROUND (a) Field of the Invention

The present invention relates to a water-flowing mechanism of a wet type electrostatic precipitator, and more particularly to a water-flowing mechanism of a wet type electrostatic precipitator having plural dust-collecting plates along a flow path of gas to be treated.

(b) Description of the Related Art

From exhaust gas from a boiler using heavy oil or coal as a fuel such as a thermal power plant, dust is removed by a dry type electrostatic precipitator, then, sulfur oxides are removed by a wet desulfurizer, and finally, mist or dust remaining in the exhaust gas is removed by a wet type electrostatic precipitator.

FIG. 14 is a general view of a wet type electrostatic precipitator according to a conventional art. FIG. 14A is a perspective view, FIG. 14B is a front view seen from an inlet port 102, and FIG. 14C is a side view of FIG. 14B. A wet type electrostatic precipitator 100 shown in FIG. 14A has a casing 101 (a portion indicated by a broken line in FIG. 14A) that forms an overall shape.

The front face of the casing 101 extends outwardly in a pyramid form. The inlet port 102 from which gas to be treated 106 is introduced is formed at the leading end of the casing 101. The back face opposite to the front face similarly extends outwardly in a pyramid form, and a discharge port 103 from which treated gas 107 is discharged is formed at its leading end (see FIGS. 14B and 14C). Here, the inlet port 102 and the discharge port 103 are formed at the center of the front face and the back face respectively considering uniform dispersion of airflow. The casing 101 is supported by legs 111 at the corners of the bottom face.

On the other hand, plural plate-like dust-collecting plates 104 (the mesh portion in FIG. 14A) and plural plate-like discharge electrodes 105 are alternatively arranged in line facing in parallel to each other at equal interval. In order to allow the gas to be treated 106 to be easily vented, the dust-collecting plates 104 and the discharge electrodes 105 are arranged such that the side faces thereof are directed toward the inlet port 102 or the discharge port 103. Strong electric field is applied between the discharge electrodes 105 and the dust-collecting plates 104.

With this configuration, the gas to be treated 106 introduced from the inlet port 102 passes between the dust-collecting plates 104 and the discharge electrodes 105, and mist and dust contained in the gas to be treated 106 are charged by the discharge electrodes 105, so that the mist and dust are attracted to the dust-collecting plates 104 with coulomb force to be colleted. The gas to be treated 106 from which mist and dust are removed is discharged from the discharge port 103 as the treated gas 107.

FIG. 15 shows a water-flowing mechanism of a wet type electrostatic precipitator according to a conventional art. As shown in FIG. 15, in a wet type electrostatic precipitator 100, spray nozzles 108 are generally arranged above the dust-collecting plates 104 as a water-flowing mechanism, wherein the mist and dust collected on the dust-collecting plates 104 are washed away by washing liquid 110 supplied from a water supply pump 109 and injected from the spray nozzles 108. Accordingly, the collection capacity of the dust-collecting plates 104 is maintained.

However, the water-flowing mechanism in the wet type electrostatic precipitator described above has a problem such that water droplets of the washing liquid injected from the spray nozzles 108 are caught in the airflow of the gas to be treated 106, and therefore, a stable water film cannot be formed on the surface of each of the dust-collecting plates 104. In the upflow type wet type electrostatic precipitator 100 in which the gas to be treated 106 is introduced from the lower part of the casing 101 and discharged from the upper part, in particular, the upflow of the gas to be treated 106 squarely collides with the droplets of the washing liquid 110 injected from the spray nozzles 108. Therefore, the phenomenon, in which the considerable amount of the droplets of the injected washing liquid 110 are discharged from the upper part of the casing 101 with the gas to be treated 106, becomes significant, which makes it more difficult to effectively form a water film on the dust-collecting plates 104.

Japanese Patent Application Laid-Open (JP-A) Nos. 2002-224588 and 2001-190982 disclose a countermeasure for solving the problem of the water-flowing mechanism in the wet type electrostatic precipitator described above.

JP-A-2002-224588 discloses a countermeasure for solving the problem of the water-flowing mechanism in the wet type electrostatic precipitator described above. FIG. 12 is a perspective view of a water-flowing mechanism disclosed in JP-A-2002-224588, and FIG. 13 is a sectional view of a washing liquid supplying part thereof. A water holding part 2 is provided at the upper part of a dust-collecting plate 1 so as to enclose the upper end 1*a* of the dust-collecting plate 1. An opening part 4 whose opening width is adjustable by a blade 3 is formed at the lower end of the water holding part 2. The opening part 4 nips the upper part of the dust-collecting plate 1 with a narrow gap formed between the opening part 4 and the dust-collecting plate 1. When washing liquid is supplied from a water supplying tube 5 connected to the upper part of the water holding part 2, the washing liquid is collected in the water holding part 2, and the washing liquid flows through the gap between the opening part 4 and the surface of the dust-collecting plate 1, whereby a water film is formed on the surface of the dust-collecting plate 1.

According to the water-flowing mechanism disclosed in JP-A-2002-224588, a stable water film can be formed on the surface of the dust-collecting plate 1 while being insignificantly affected by the airflow of the gas to be treated. JP-A-2001-190982 discloses a similar water-flowing mechanism.

However, in the water-flowing mechanism disclosed in JP-A-2002-224588, when washing liquid is supplied to the empty water holding part 2 at the beginning of the operation, a plenty of washing liquid leaks from the partial gap between the opening part 4 and the dust-collecting plate 1, which means a plenty of washing liquid vigorously leaks. Therefore, there arises a problem that even if the supplying flow-rate of the washing liquid from the water supplying tube 5 is increased more than the washing liquid leaking from the gap, it takes long time to fill the water holding part 2 with the washing liquid to full capacity, and the formation of the water film on the surface of the dust-collecting plate 1 becomes very unstable until the water holding part 2 is filled with the washing liquid. Further, the function of adjusting the supplying flow-rate of the washing liquid is extremely insufficient in the water-flowing mechanism. Specifically, when the supplying flow-rate of the washing liquid from the water supplying tube 5 is decreased for some reason to be less than a lower limit value even after the water holding part 2 is filled with the washing liquid to full capacity, the water surface at the water holding part 2 is lowered, and finally, the washing liquid flows only through a partial gap, which makes it difficult to form the water film on the entire surface of the dust-collecting plate 1.

The water-flowing mechanism disclosed in JP-A-2001-190982, also have the similar problems although there is a difference in the degree.

SUMMARY OF THE INVENTION

An object of the present invention is to eliminate the aforesaid problems of the conventional technique, and provide a water-flowing mechanism in a wet type electrostatic precipitator that can stably and quickly form a water film on a dust-collecting plate even at the beginning of the operation and that has an excellent adjusting function of a supplying flow-rate of washing liquid.

In order to achieve the foregoing object, a water-flowing mechanism of a wet type electrostatic precipitator according to the first aspect of the present invention includes a dust-collecting plate, a cylindrical member that is arranged according to the shape of the upper end face of the dust-collecting plate and has an open lower part, and a washing liquid supplying source that is arranged in the cylindrical member and supplies washing liquid to wet the dust-collecting plate.

According to the second aspect, a water-flowing mechanism of a wet type electrostatic precipitator includes a dust-collecting plate, a cylindrical member that is arranged according to the shape of the upper end face of the dust-collecting plate and has an open lower part, and a spray nozzle that is arranged in the cylindrical member and injects washing liquid toward the ceiling surface of the cylindrical member to wet the dust-collecting plate.

According to the third aspect, the horizontal cross-sectional face of the dust-collecting plate is formed in a corrugated shape, and the lower opening of the cylindrical member is formed in a corrugated shape according to the dust-collecting plate.

According to the fourth aspect, the horizontal cross-sectional face of the dust-collecting plate is formed in a corrugated shape, the lower opening of the cylindrical member is formed in a corrugated shape according to the dust-collecting plate, and the water-flowing mechanism further includes a lifting beam that contacts for fixation with the dust-collecting plate, and a spacer that forms a gap, through which the washing liquid flows, at the contact portion between the dust-collecting plate and the lifting beam.

According to the fifth aspect, the horizontal cross-sectional face of the dust-collecting plate is formed in a corrugated shape, the open lower part of the cylindrical member is formed in a corrugated shape according to the dust-collecting plate, and the water-flowing mechanism further comprises a lifting beam that contacts for fixation with the dust-collecting plate, a spacer that forms a gap, through which the washing liquid flows, at the contact portion between the dust-collecting plate and the lifting beam, and rectifying means that rectifies the washing liquid, which is supplied to the gap, below the contact portion of the dust-collecting plate and the lifting beam in the gap.

According to the water-flowing mechanism in the wet type electrostatic precipitator of the present invention, the cylindrical member functions as a protective barrier that protects the droplets of the washing liquid, which are injected from the spray nozzle, from the airflow of the gas to be treated. Therefore, the droplets of the injected washing liquid is prevented from being caught in the airflow of the gas to be treated, like the spray nozzle system according to the conventional technique, whereby a stable water film can be formed on the entire surface of the dust-collecting plate by appropriately designing the attachment space of the spray nozzle. Particularly in the upflow type wet type electrostatic precipitator, the mechanism is effective since the upflow of the gas to be treated does not surely collides with the droplets of the washing liquid injected from the spray nozzle.

Compared to the water-flowing mechanism disclosed in JP-A-2002-224588 and JP-A-2001-190982, the water film can stably and quickly be formed on the dust-collecting plate at the beginning of the operation. Further, adjusting of the supplying flow-rate of the washing liquid according to the operation condition becomes easy.

Further by providing the spacer for forming the gap, through which the washing liquid flows, at the contact portion of the dust-collecting plate having the horizontal cross-sectional face formed in a corrugated shape and the lifting beam, the washing liquid can sufficiently be spread even to the belly portion of the dust-collecting plate to which the washing liquid is difficult to spread. Further, since the water-flowing mechanism includes the rectifying means that can rectify the washing liquid, which is supplied to the gap, below the contact portion of the dust-collecting plate and the lifting beam in the gap, the washing liquid can sufficiently be spread to the portion immediately below a bolt that tightens the dust-collecting plate with a nut at the belly portion.

DETAILED DESCRIPTION OF THE PREFERRED EMBODIMENTS

Figure 1:
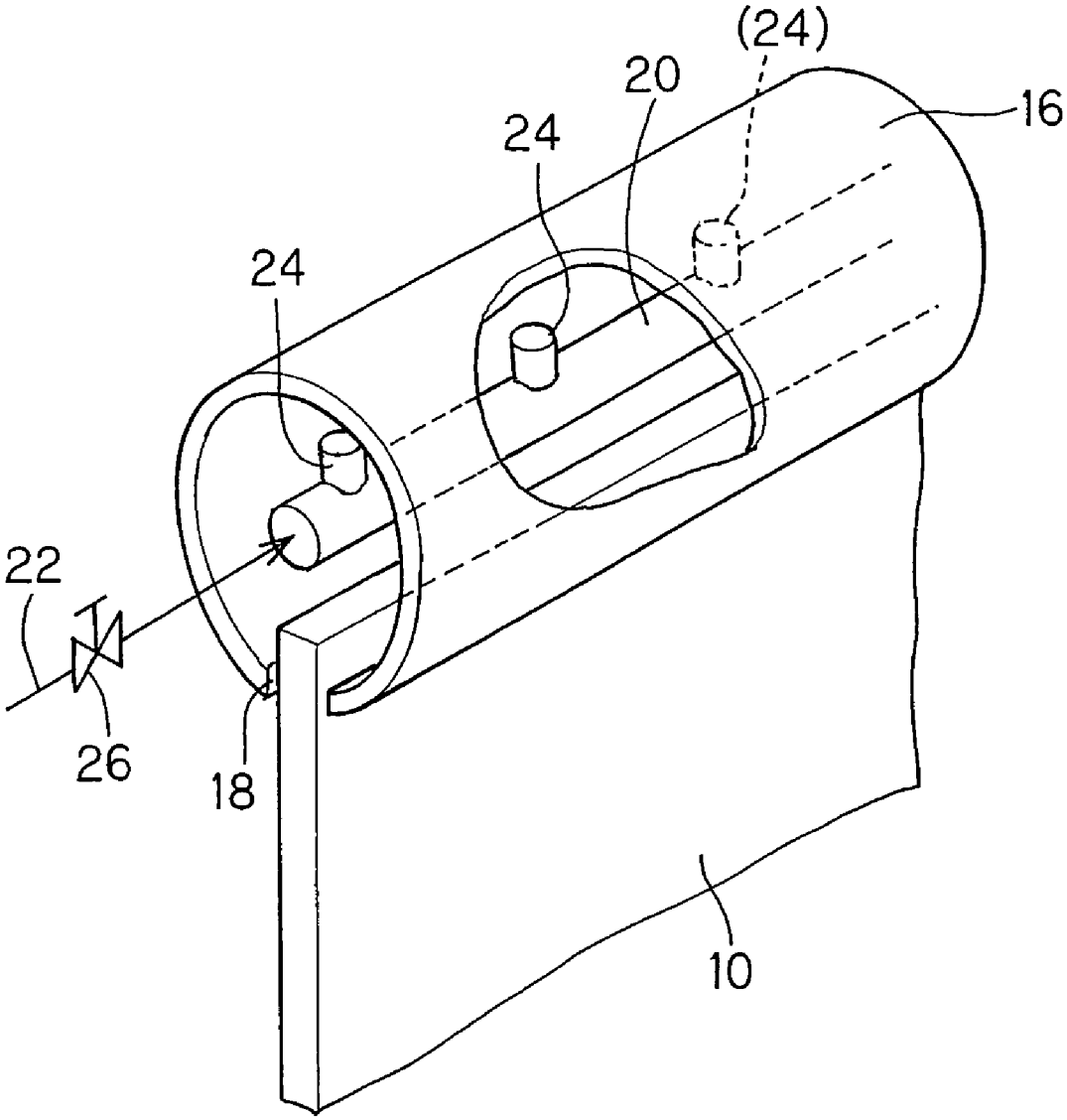
FIG. 1 is a perspective view showing a first embodiment of the present invention.
Figure 2:
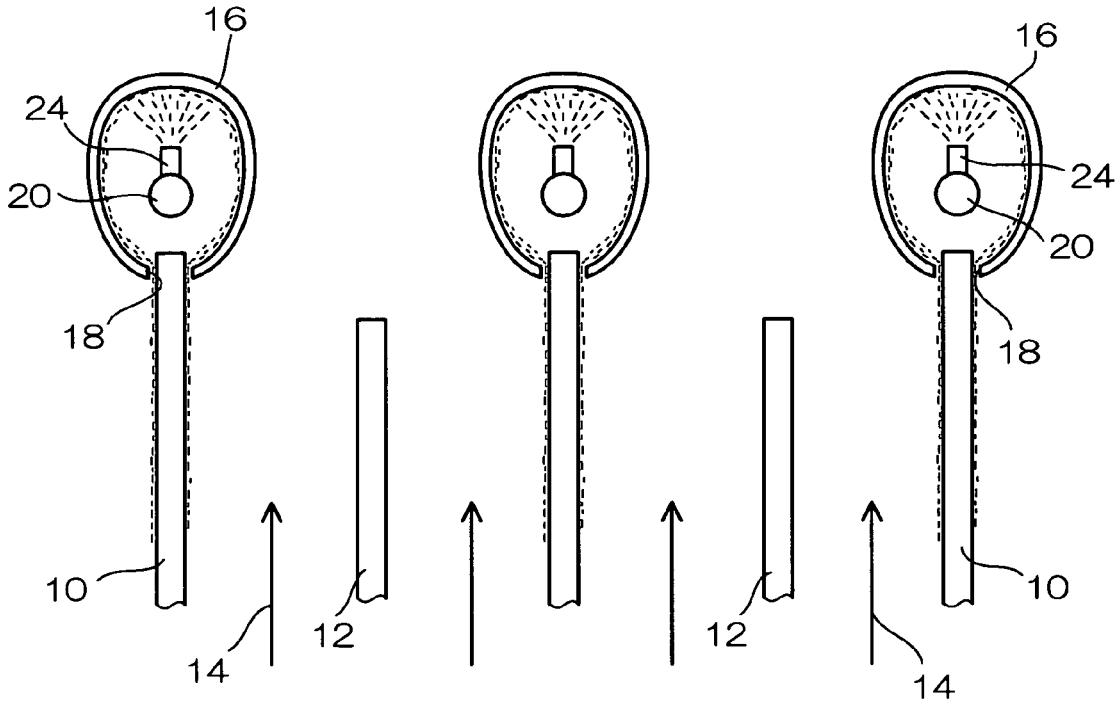
FIG. 2 is a side view of the first embodiment.

FIG. 1 is a perspective view showing a first embodiment of a water-flowing mechanism of a wet type electrostatic precipitator according to the present invention, and FIG. 2 is a side view of the first embodiment. The first embodiment is characterized by including a dust-collecting plate 10, a water injecting pipe 20 that serves as a washing liquid supplying source that supplies the washing liquid to wet the dust-collecting plate, and a cylindrical member 16, of which a lower part opens according to the shape of upper end face of the dust-collecting plate 10 and into which the water injecting pipe 20 as a washing liquid supplying source, is inserted.

As shown in FIG. 2, plural dust-collecting plates 10 and discharge electrodes 12 are alternately arranged along a flow path of a flowing up gas to be treated 14 at equal intervals in a casing of the wet type electrostatic precipitator. High voltage is applied to the discharge electrodes 12, so that mist and dust in the gas to be treated 14 are collected on the dust-collecting plates 10 based on a principle of electric dust collection.

The cylindrical member 16 is arranged along the upper edge of each of the dust-collecting plates 10. Each of the lower part of the cylindrical member 16 is open, wherein the lower opening 18 nips the upper end of the dust-collecting plate 10 with a narrow gap formed between the lower opening 18 and the surface of the dust-collecting plate 10. The water injecting pipe 20 is arranged at the center of the cylindrical member 16. A washing liquid supplying pipe 22 is connected to one end of the water injecting pipe 20. Plural spray nozzles 24 are attached to the water injecting pipe 20 in such a manner that the injecting direction of each of the spray nozzles 24 is directed to the ceiling surface of the cylindrical member 16 with a certain space.

According to the water-flowing mechanism thus configured, when a flow-rate adjusting valve 26 provided to the water supplying pipe 22 is opened, the washing liquid of a desired flow rate is quickly filled in the water injecting pipe 20, and the washing liquid is injected toward the ceiling surface of the cylindrical member 16 from each of the spray nozzles 24 to collide with the ceiling surface of the cylindrical member 16. The washing liquid colliding with the ceiling surface spreads over the ceiling surface by the collision energy, and then, flows down toward the lower opening 18 through the inner surface of the cylindrical member 16. Since this washing liquid passes through the narrow gap formed between the lower opening 18 and the surface of the dust-collecting plate 10 at the lower opening 18, the washing liquid flows down along the dust-collecting plate 10 as rectified while forming a water film on the surface of the dust-collecting plate 10.

Therefore, according to the water-flowing mechanism of the wet type electrostatic precipitator of the present embodiment, the droplets of the injected washing liquid are not caught in the airflow of the gas to be treated as it has been with a conventional spray nozzle type device, thereby the stable water film can be formed on the entire surface of the dust-collecting plate 10 by appropriately designing the attachment space of the spray nozzle 24. In particular, this configuration is effective for the upflow type wet type electrostatic precipitator configured such that the gas to be treated 14 is introduced from the lower part of the casing and discharged to upper part, since there is no chance that the upflow of the gas to be treated 14 squarely collides with the droplets of the washing liquid injected from the spray nozzle.

Compared to the water-flowing mechanism disclosed in Japanese Unexamined Patent Application No. 2002-224588 and Japanese Unexamined Patent Application No. 2001-190982, the water film can stably and quickly be formed on the dust-collecting plate at the beginning of the operation. Further, the supplying flow-rate of the washing liquid can arbitrarily be adjusted according to the operation condition by changing the opening of the flow-rate adjusting valve 26 provided to the water supplying pipe 22.

Figure 3:
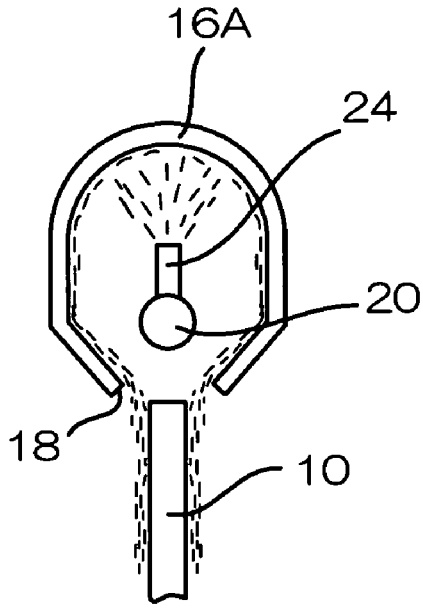
FIG. 3 is a perspective view showing a second embodiment of the present invention.

FIG. 3 is a side view showing a second embodiment of the water-flowing mechanism of a wet type electrostatic precipitator according to the present invention. In FIG. 3, the components having the numerals same as those in FIG. 2 have the function same as that in the first embodiment, therefore the explanation thereof is not repeated here. In the present embodiment, the lower opening 18 of a cylindrical member 16A is located at a position slightly higher than the upper end of the dust-collecting plate 10. The washing liquid flowing down to the lower opening 18 through the inner surface of the cylindrical member 16A reaches the dust-collecting plate 10 by inertial force based upon flow velocity energy, thereby forming a water film on the surface of the dust-collecting plate similar to the first embodiment.

Figure 4:
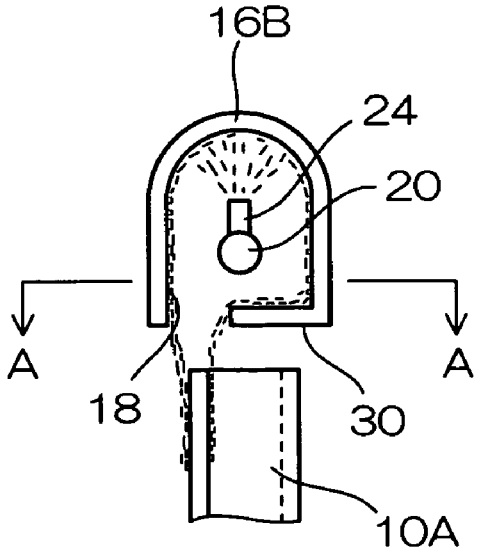
FIG. 4 is a side view showing a third embodiment of the present invention.
Figure 5:
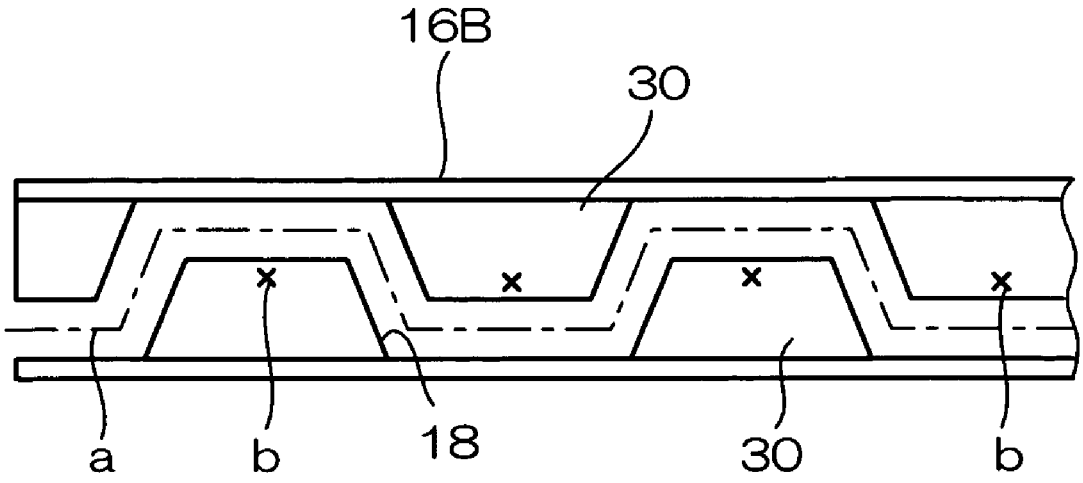
FIG. 5 is a view taken along a line A-A in FIG. 4 seen from an arrow.

FIG. 4 is a side view showing a water-flowing mechanism of a wet type electrostatic precipitator of a third embodiment according to the present invention, and FIG. 5 is a view taken along a line A-A in FIG. 4 seen from an arrow.

The third embodiment is characterized by including a dust-collecting plate 10A, a spray nozzle 24 that supplies washing liquid to wet the dust-collecting plate 10A and serves as a washing liquid supplying source, and a cylindrical member 16, of which a lower part opens according to the shape of the upper end face of the dust-collecting plate 10 and into which the spray nozzle 24 as a washing liquid supplying source, is inserted, wherein the horizontal cross-section of the dust-collecting plate 10 is formed in a corrugated shape, and the lower opening 18 of the cylindrical member 16B is formed in a corrugated shape according to the dust-collecting plate 10A.

Figure 6:
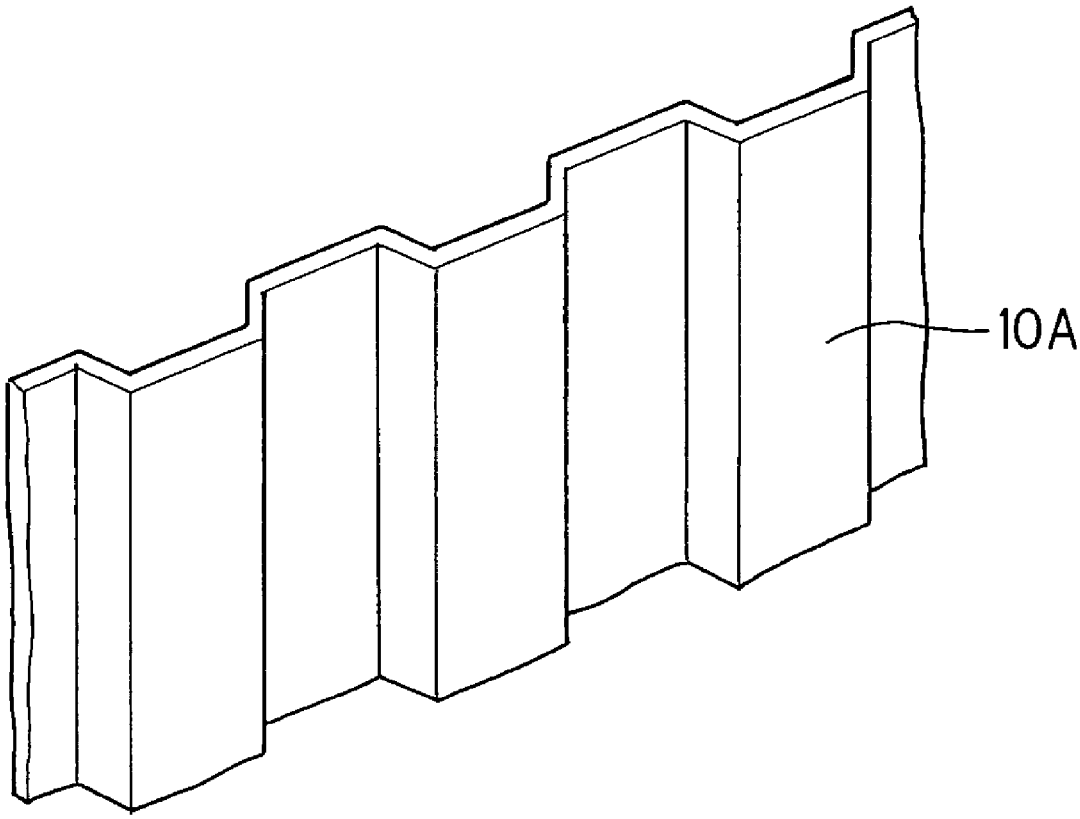
FIG. 6 is a perspective view showing a dust-collecting plate according to the third embodiment.

In FIGS. 4 and 5, the components having the numerals same as those in FIG. 2 have the functions similar to those in the first embodiment, therefore the explanation is not repeated here. The water-flowing mechanism according to the present embodiment may be applicable to the case in which the horizontal cross-section of the dust-collecting plate 10A is corrugated as shown in the perspective view of FIG. 6. The lower opening 18 of the cylindrical member 16B is formed in a corrugated shape according to a centerline a of the dust-collecting plate 10A. Therefore, the washing liquid injected toward the ceiling surface of the cylindrical member 16B from the spray nozzle 24 spreads over the ceiling surface, and then, flows down along the corrugated dust-collecting plate 10A from the lower opening 18 through the inner surface of the cylindrical member 16B or lower projecting surface 30. It is to be noted that the mark b shown in FIG. 5 indicates the center position of the spray nozzle 24 arranged in the cylindrical member 16B.

Figure 7:
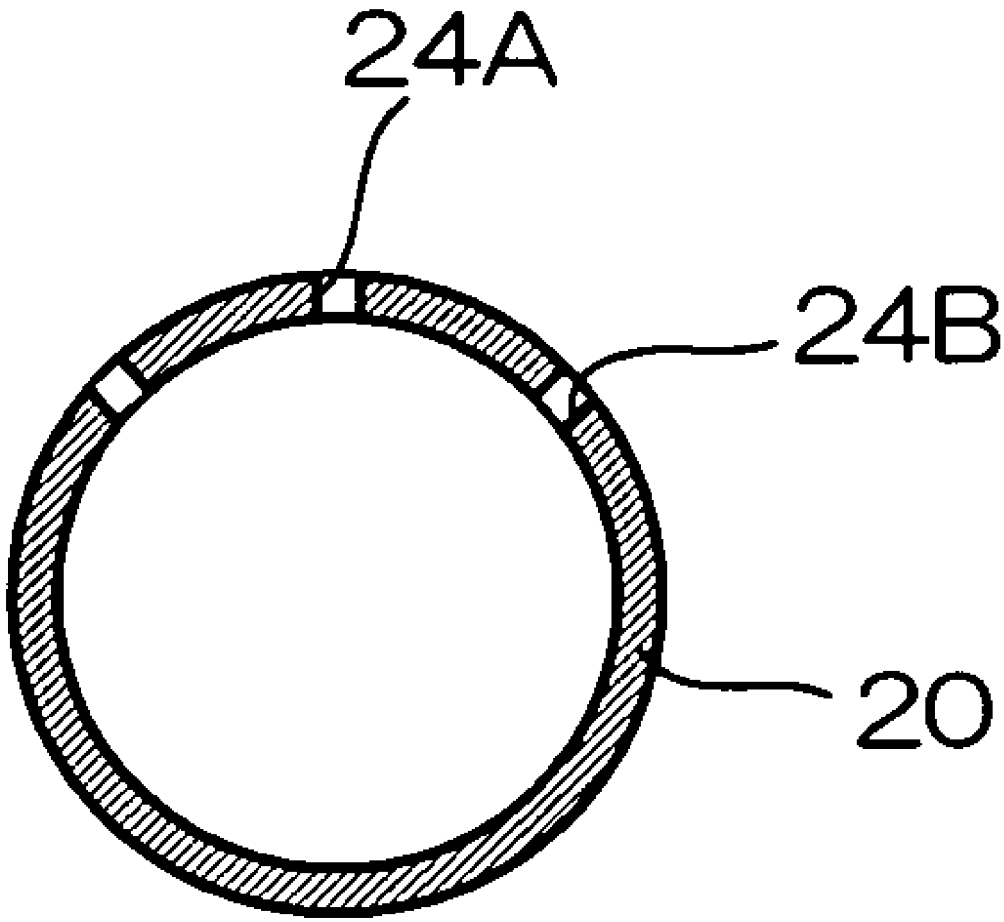
FIG. 7 is a sectional view showing a modification of a spray nozzle.

A commercially available product that sprays the washing liquid in a corn shape is effective for the spray nozzle 24 shown in the aforesaid embodiments, but the spray nozzle according to the present invention is not limited thereto. As shown in FIG. 7, a blowout hole formed on the water injecting pipe 20 may also be employed as the spray nozzle. In this case, in addition to a blowout hole 24A that injects washing liquid toward the ceiling surface immediately above the water injecting pipe 20, a blowout hole 24B that injects the washing liquid toward the ceiling surface diagonally above the water injecting pipe 20 may be formed.

Figure 8:
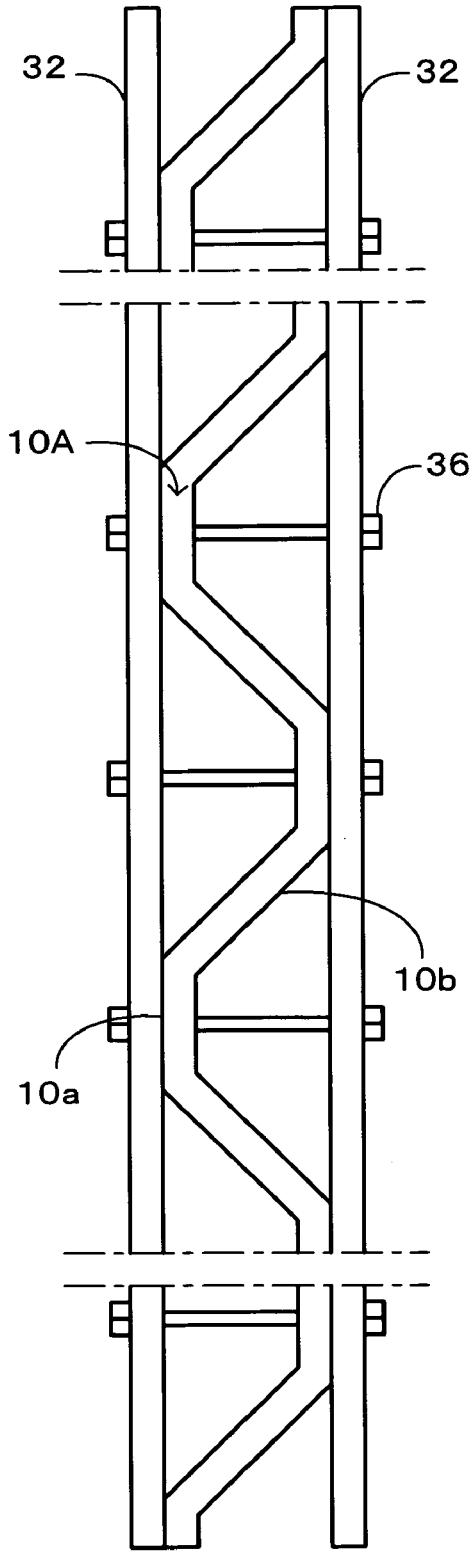
FIG. 8 is a plan view when the dust-collecting plate is fixed by a lifting beam.

Practically, the dust-collecting plate attached to the wet type electrostatic precipitator generally employs a sheet pile structure in which the plate is bent into a corrugated shape having a fold in a vertical direction, in order to secure the rigidity. Viewed from the vertical direction, the end face is not a straight line, but is in a trapezoidal shape in which belly parts and side parts are continuous. FIG. 8 is a plan view showing the case in which the dust-collecting plate is fixed by a lifting beam. As shown in FIG. 8, the lifting beam 32 is a plate whose width in the longitudinal direction is a certain thickness that is the same as or longer than the width in the horizontal direction of the dust-collecting plate 10A, which stands upright. The lifting beam 32 is fixed to a outer casing (not shown), thereby the dust-collecting plate 10A is fixed. The dust-collecting plate 10A has a sheet pile structure, constituted by belly parts 10*a* that contact with the lifting beam 32 and side parts 10*b* that do not contact with the lifting beam 32. The dust-collecting plate 10A is fixed to the lifting beam 32 in such a manner that the dust-collecting plate 10A is sandwiched between two lifting beams 32, which are parallel to each other at the upper end portion and lower end portion of the dust-collecting plate 10A, bolt holes are formed at the contact portion of the dust-collecting plate 10A and the belly parts 10*a* and at the opposing lifting beam 32, and the dust-collecting plate 10A and the lifting beams 32 are fixed by bolt and nut using bolts. In this case, the washing liquid spreads over the side parts 10*b* of the dust-collecting plate 10A, but the belly parts 10*a* at the position below the contact portion to the lifting beam 32, wettability is reduced, so that the cleaning efficiency of the dust-collecting plate is reduced. Further, since the boundary between the wet portion and the dry portion is easy to be corroded, the lifetime of the dust-collecting plate is shortened. In view of this, the embodiment described below can be employed.

Figure 9:
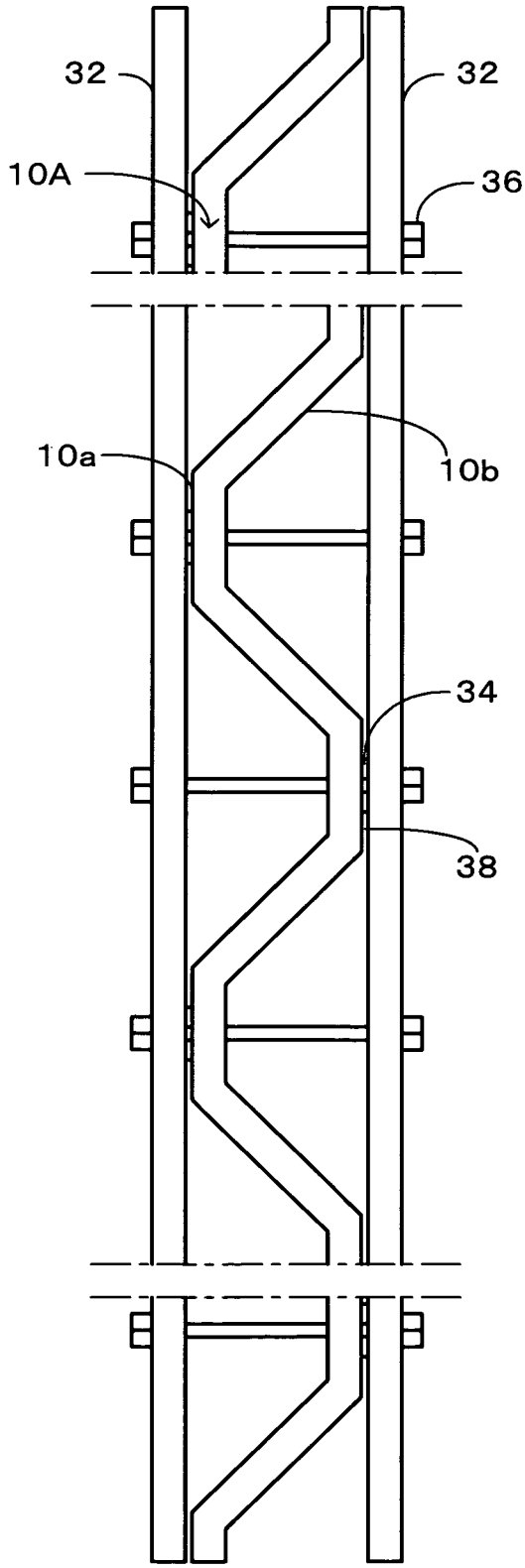
FIG. 9 is a plan view showing a fourth embodiment of the present invention.

FIG. 9 shows a water-flowing mechanism of a wet type electrostatic precipitator according to a fourth embodiment. The water-flowing mechanism of the wet type electrostatic precipitator according to the fourth embodiment is characterized by including a dust-collecting plate 10A, a spray nozzle 24 that supplies washing liquid to wet the dust-collecting plate 10A and serves as a washing liquid supplying source, and a cylindrical member 16B, of which a lower part opens according to the shape of the upper end face of the dust-collecting plate 10 and into which the spray nozzle 24 as a washing liquid supplying source, is inserted, wherein the horizontal cross-section of the dust-collecting plate 10 is formed in a corrugated shape, and the lower opening 18 of the cylindrical member 16B is formed in a corrugated shape according to the dust-collecting plate 10A, the water-flowing mechanism further including a lifting beam 32 that contacts for fixation with the dust collecting plate 10A and a spacer 34 that forms a gap 38, through which the washing liquid flows, at the contact portion of the dust-collecting plate 10A and the lifting beam 32.

The structures of the cylindrical member 16B and the spray nozzle 24 mounted to the dust-collecting plate 10A are similar to those in the third embodiment, therefore the explanation is not repeated here. Bolt holes should be formed such that the upper end face of the lifting beam 32 is lower than the upper end face of the dust-collecting plate 10A so that the lifting beam 32 and the cylindrical member 16B do not interfere with each other. The spacer 34 is inserted at the contact portion of the belly part 10*a* of the dust-collecting plate 10A and the lifting beam 32. The spacer 34 is a plate material that has a thickness allowing forming a later described gap 38 through which the washing liquid can flow, that is difficult to be corroded by water, and is of certain hardness. The spacer 34 may be fixed by bolt and nut to be held between the belly part 10*a* of the dust-collecting plate 10A and the lifting beam 32 or bonded to the belly part 10*a* of the dust-collecting plate 10A or the lifting beam 32 at the contact portions. At this time, the dust-collecting plate 10A is fixed to the lifting beam 32 through the bolt 36 in the height direction, and is fixed to the lifting beam 32 through the spacer 34 in the widthwise direction. A washer 42 (see FIG. 11) inserted into the bolt 36 may be employed as the spacer 34. With this structure, the gap 38 is formed between the belly part 10*a*, which is the side face of the dust-collecting plate, and the lifting beam 32. Since the washing liquid flows above the gap 38 from the cylindrical member 16B mounted to the upper end of the dust-collecting plate 10A, the washing liquid passes through the gap 38. Accordingly, the washing liquid can sufficiently be spread over the belly parts 10*a*, to which the washing liquid is difficult to be spread, of the dust-collecting plate 10A. However, in the fourth embodiment, the washing liquid cannot be supplied to the portion immediately below the bolt 36 of the belly part 10*a* of the dust-collecting plate 10A. Therefore, an embodiment described below may be considered.

Figure 10:
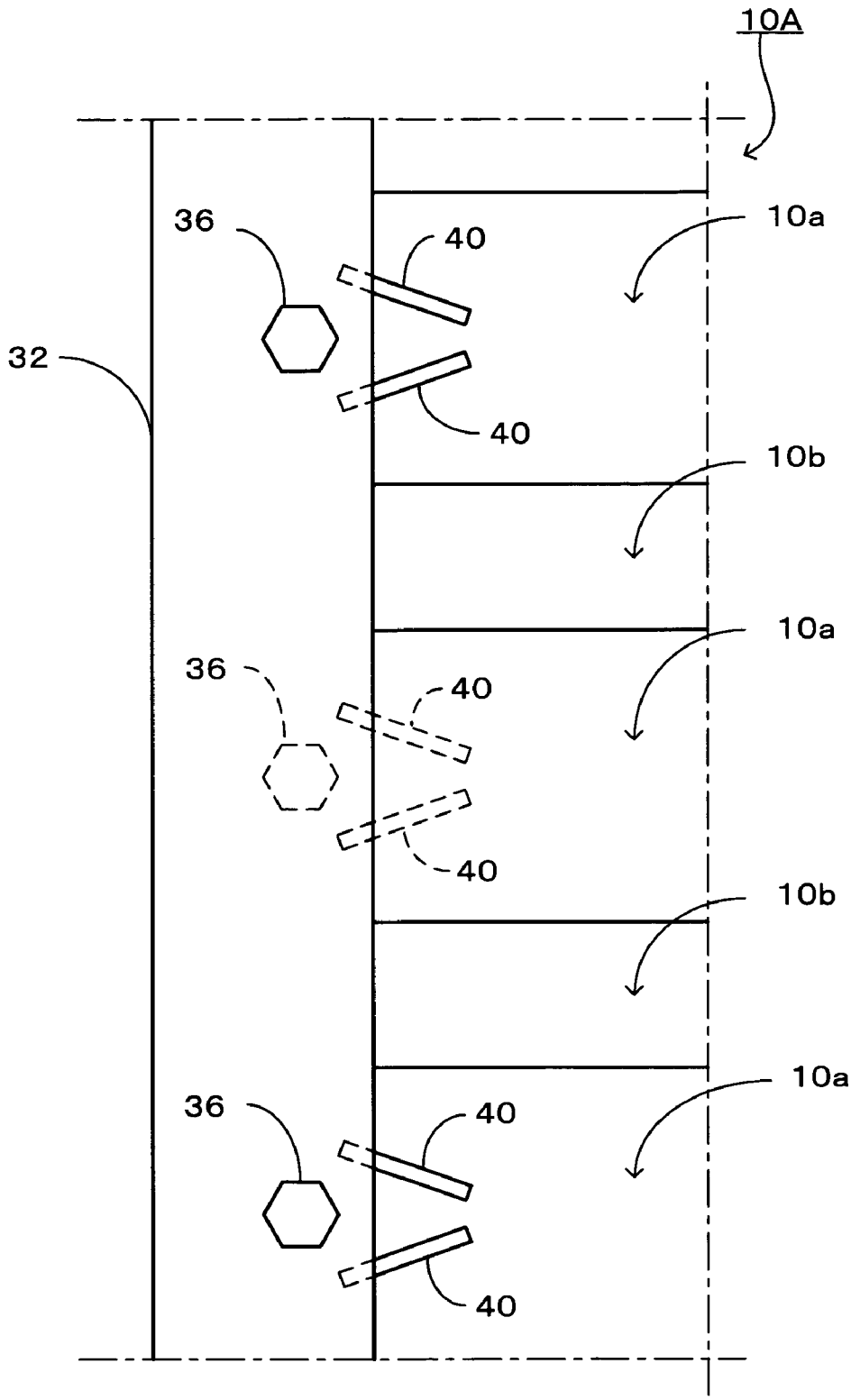
FIG. 10 is a front view showing a fifth embodiment of the present invention.

FIG. 10 shows a water-flowing mechanism of a wet type electrostatic precipitator according to a fifth embodiment. The water-flowing mechanism of the wet type electrostatic precipitator according to the fifth embodiment is characterized by including a dust-collecting plate 10A, a spray nozzle 24 that supplies washing liquid to wet the dust-collecting plate 10A and serves as a washing liquid supplying source, and a cylindrical member 16B, of which a lower part opens according to the shape of the upper end face of the dust-collecting plate 10 and into which the spray nozzle 24 as a washing liquid supplying source, is inserted, wherein the horizontal cross-section of the dust-collecting plate 10 is formed in a corrugated shape, and the lower opening 18 of the cylindrical member 16B is formed in a corrugated shape according to the dust-collecting plate 10A, the water-flowing mechanism further including a lifting beam 32 that contacts for fixation with the dust collecting plate 10A and a spacer 34 that forms a gap 38, through which the washing liquid flows, at the contact portion of the dust-collecting plate 10A and the lifting beam 32, and a rectifying plate 40 that serves as rectifying means and that can rectify the washing liquid, supplied in the gap 38 to the portion below the contact portion of the dust-collecting plate 10A and the lifting beam 32 in the gap 38.

The basic structure is almost similar to that in the fourth embodiment. The rectifying plate 40 as rectifying means, which is not included in the fourth embodiment, may be of a band-like form or a rectangular thin plate. The rectifying plate 40 has a thickness allowing forming a gap 38, through which the washing liquid can flow to the contact surface of the belly part 10*a* of the dust-collecting plate 10A and the lifting beam 32. The rectifying plate 40 is fixed as described below as shown in FIG. 5. Specifically, the bolt nut fixation for the lifting beam 32 and the belly part 10*a* of the dust-collecting plate 10A is temporarily eased to form a gap, having a thickness substantially the same as the thickness of the rectifying plate 40, between those. Then, a pair of rectifying plates 40 is inserted into the gap in such a manner that one end at the position slightly lower than the bolt position with the bolt 36 nipped therebetween to form a V-like shape. Thereafter, the bolt 36 is fixed again. This operation is performed around all bolts 36. Therefore, the rectifying plate 40 has a function of not only the rectifying means but also the spacer 34.

When the angle of the rectifying plate 40 is small (in the case of almost perpendicular) in the fifth embodiment, the washing liquid cannot be directed toward the center of the belly part 10*a*. Contrarily, when the angle is great (in the case of almost horizontal), the washing liquid can be directed toward the center of the belly part 10*a*, but the washing liquid cannot flow to the portion immediately below the rectifying plate 40. Therefore, the angle of the rectifying plate 40 should be adjusted, while actually flowing the washing liquid, in order to spread the washing liquid to the center of the belly part 10*a* and the portion immediately below the rectifying plate 40.

Figure 11A:
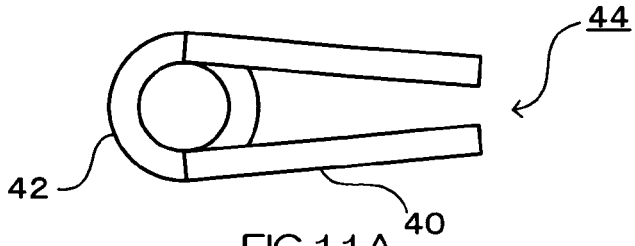
FIG. 11 is a front view and a side view showing a modification of the fifth embodiment of the present invention.

When the washer is used as the spacer 34, the washer can be configured such that a rectifying function is provided to a washer portion. FIG. 11A is a front view of a washer 44 with a rectifying plate, FIG. 11B is a side view of FIG. 11A, FIG. 11C is a front view of a washer 46 with a long-legged rectifying plate, FIG. 11D is a side view of FIG. 11C, FIG. 11E is a front view of a half washer with a rectifying plate, and FIG. 11F is a side view of FIG. 11E.

Figure 11B:
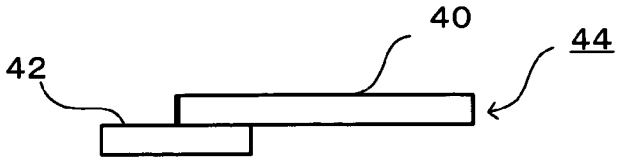
Figure 11C:
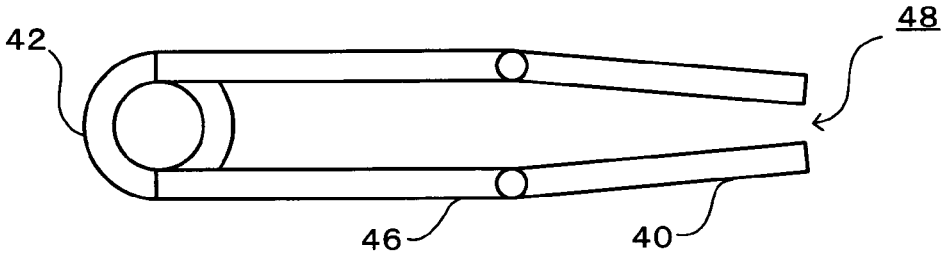
Figure 11D:
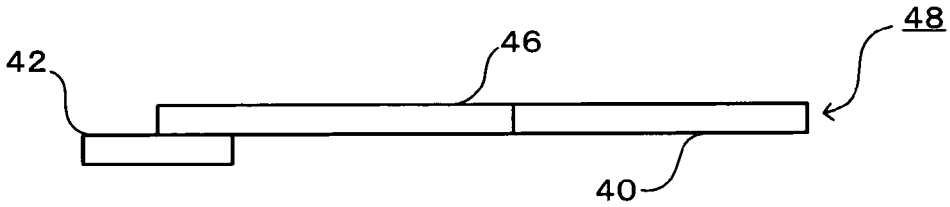

As shown in FIGS. 11A and 11B, the washer 44 with the rectifying plate is formed by mounting the rectifying plate 40 to the washer 42. As shown in FIGS. 11C and 11D, the washer 48 with the long-legged rectifying plate, having legs 46 as needed for adjusting the flowing position of the washing liquid, may be employed.

Figure 11E:
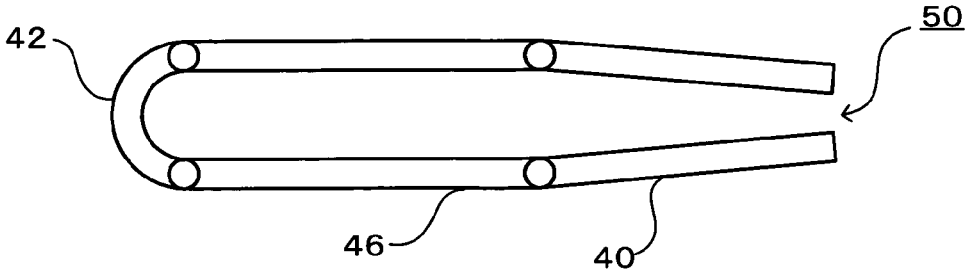
Figure 11F:
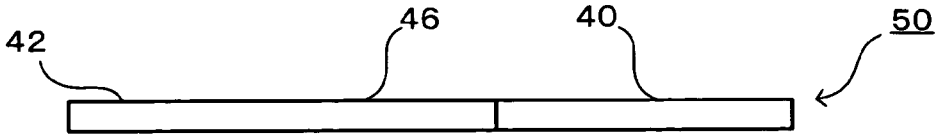
Figure 12:
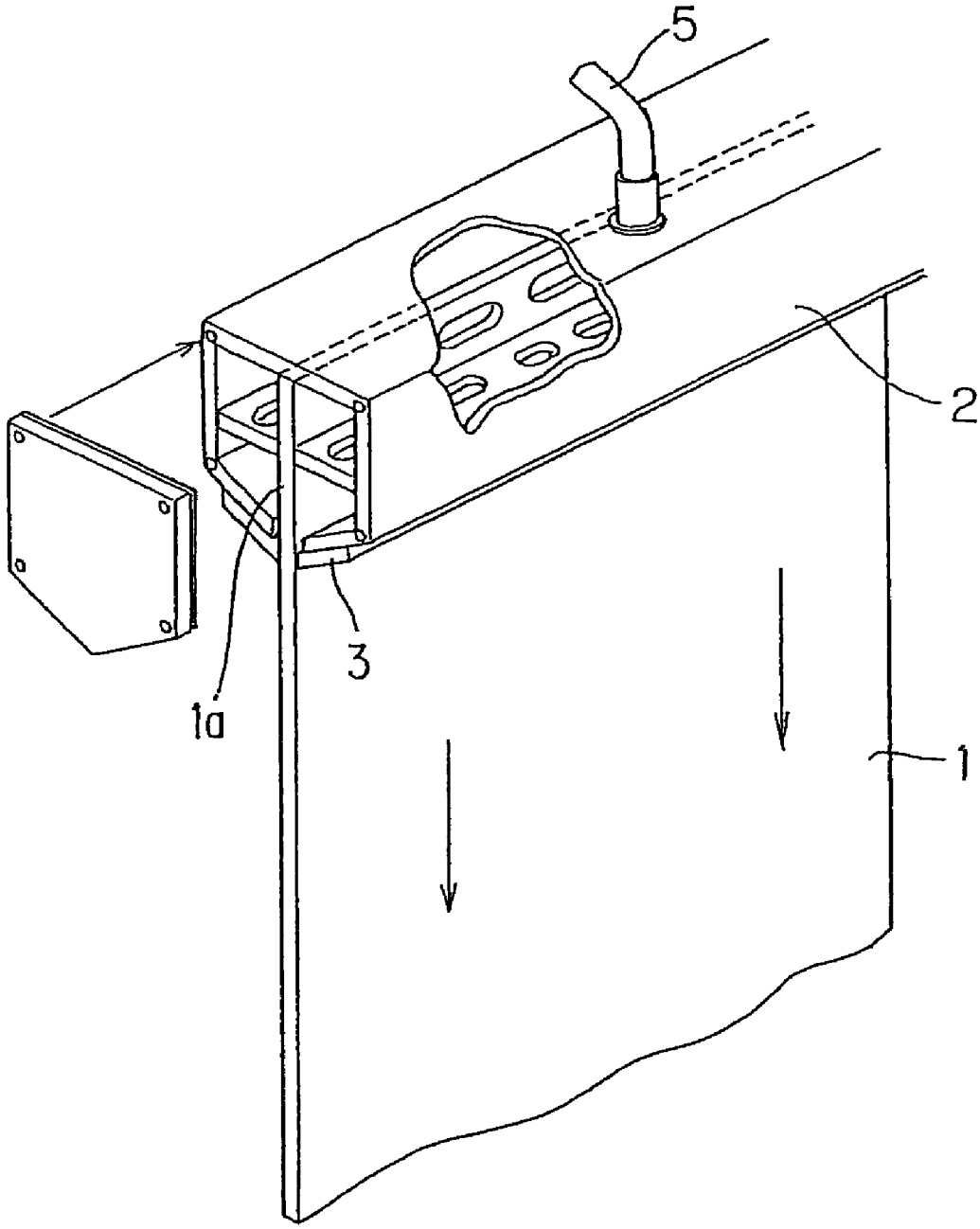
FIG.12 Related Art
FIG. 12 is a perspective view showing a water-flowing mechanism according to a conventional art.
Figure 13:
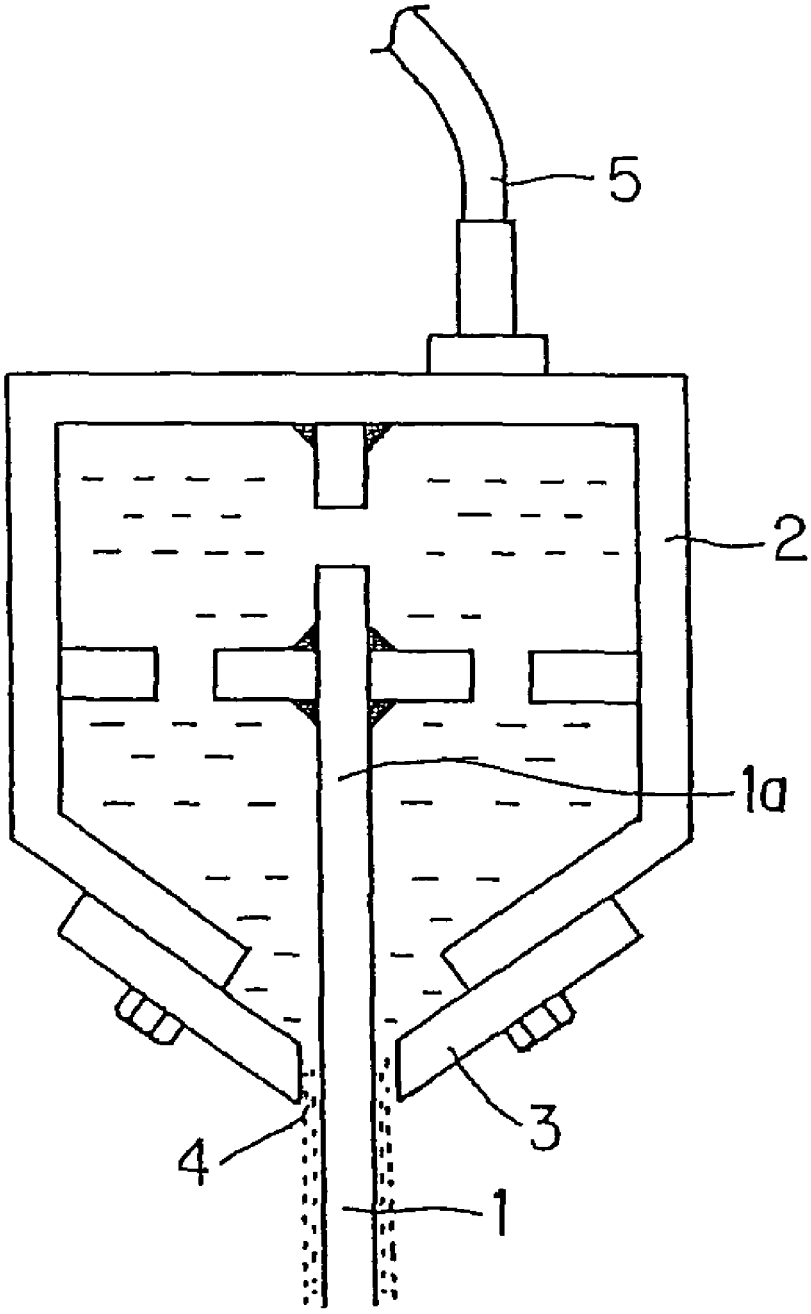
FIG.13 Related Art
FIG. 13 is a sectional view showing a washing liquid supplying part of a water-flowing mechanism according to the conventional art.
Figure 14A:
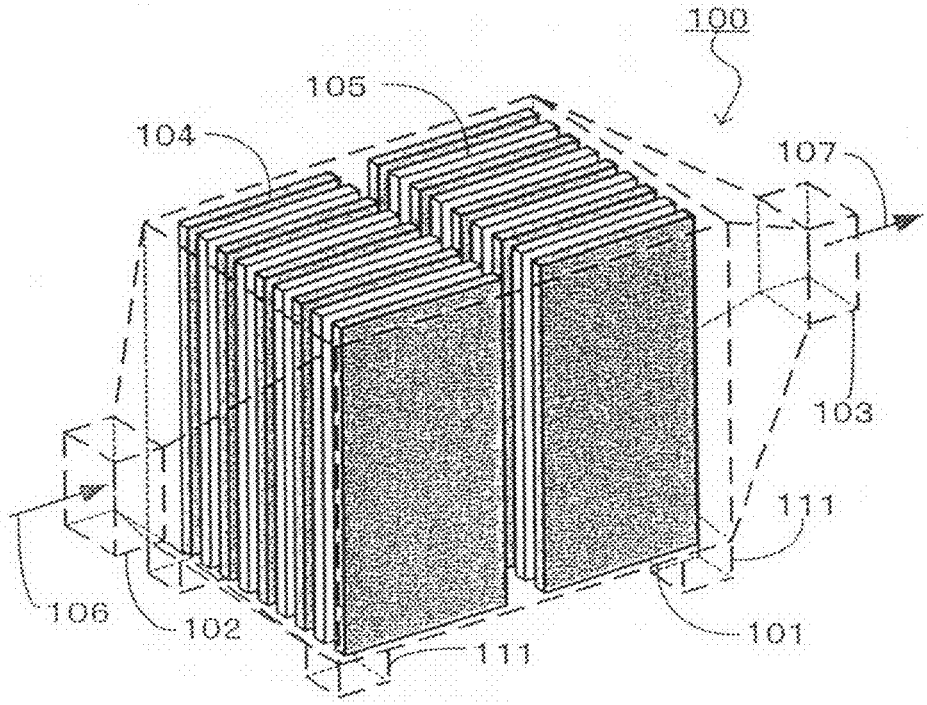
FIG.14A Related Art
FIG. 14 is an overall view of a wet type electrostatic precipitator according to the conventional art.
Figure 14B:
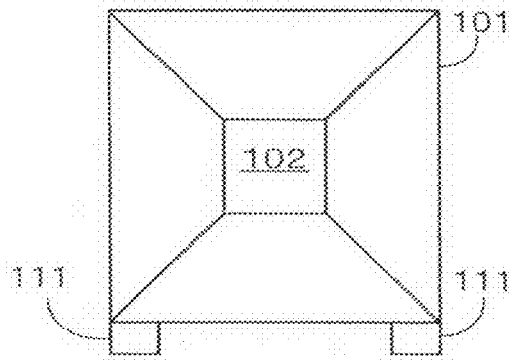
FIG.14B Related Art
Figure 14C:
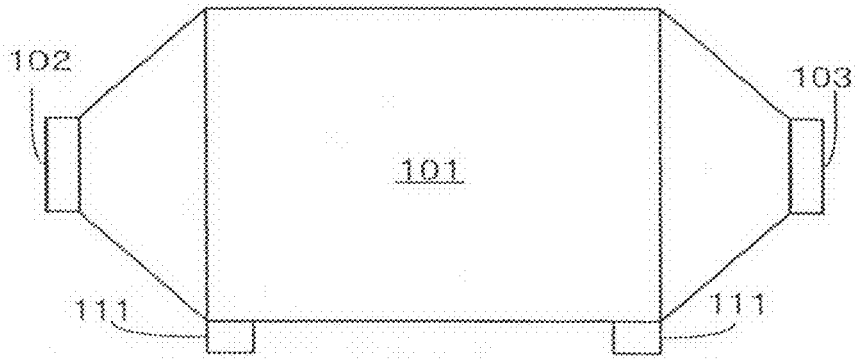
FIG.14C Related Art
Figure 15:
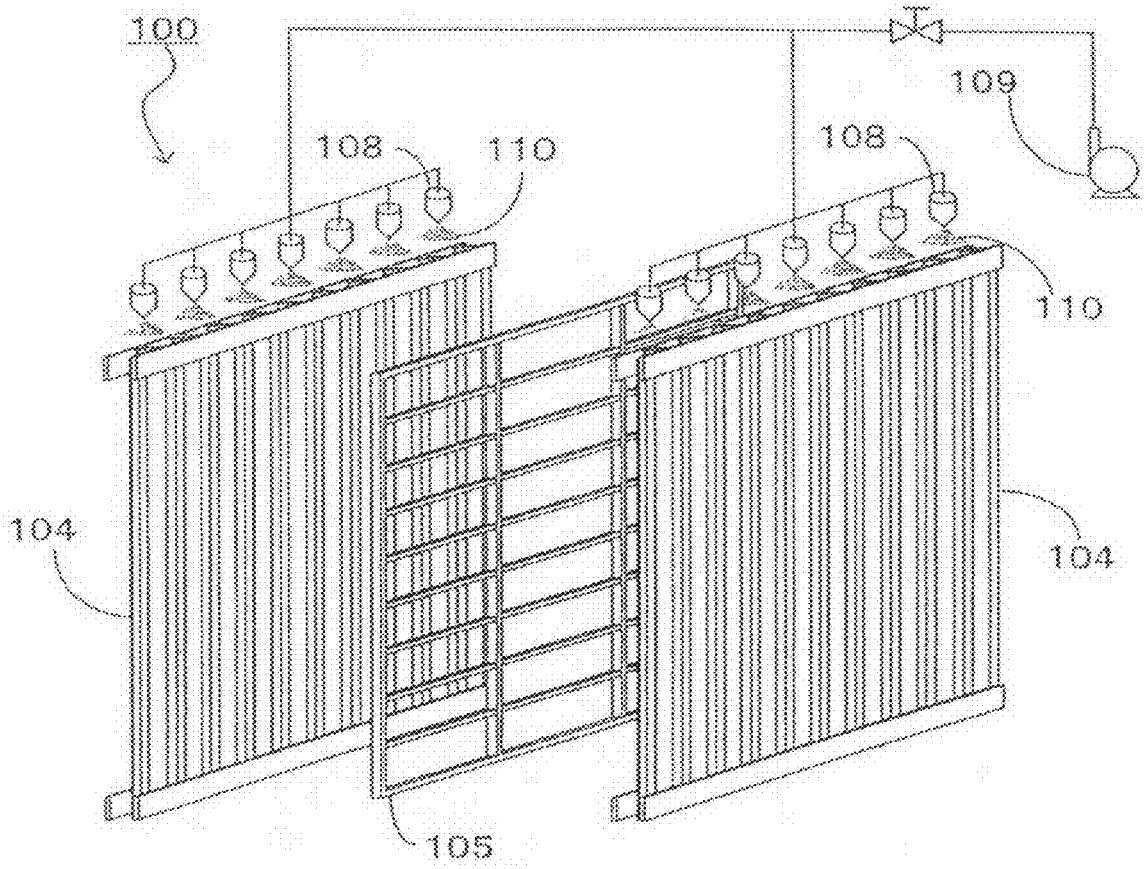
FIG.15 Related Art
FIG. 15 is a schematic view of a water-flowing mechanism of a wet type electrostatic precipitator according to the conventional art.

As shown in FIGS. 11E and 11F, the half washer 50 with the rectifying plate can be configured by dividing the washer in half, and then, mounting a leg 42 to the divided end face. At this time, the bolt 36 can be inserted between the rectifying plates 40. Therefore, the half washer 50 with the rectifying plate can easily be mounted to the bolt 36 only by easing the bolt 36, without pulling out the bolt 36 from the dust-collecting plate 10A and the lifting beam 32.

The spacer 34 and the rectifying means may be separately formed, but in this case, it is necessary that the each thickness is made equal. With this configuration, the washing liquid can sufficiently be spread to the portion immediately below the bolt that is fixed at the belly part 10*a* of the dust-collection plate 10A.

What is claimed is:

1. A water-flowing mechanism of a wet electrostatic precipitator comprising:

a dust-collecting plate;

a cylindrical member that is arranged according to the shape of the upper end face of the dust-collecting plate and has an open lower part and an inner surface, the inner surface of a lower part of the cylindrical member being downwardly inclined toward the dust-collecting plate; and a washing liquid supplying pipe that is arranged in the cylindrical member, the washing liquid supply pipe having washing liquid supplying sources that supply washing liquid such that the washing liquid falls along an inner wall of the cylindrical member and exits from the open lower part to wet the dust-collecting plate.

2. A water-flowing mechanism of a wet electrostatic precipitator according to claim 1, wherein the horizontal cross-sectional face of the dust-collecting plate is formed in a corrugated shape, and the lower opening of the cylindrical member is formed in a corrugated shape according to the dust-collecting plate.

3. A water-flowing mechanism of a wet electrostatic precipitator according to claim 1, wherein the horizontal cross-sectional face of the dust-collecting plate is formed in a corrugated shape, the lower opening of the cylindrical member is formed in a corrugated shape according to the dust-collecting plate, and the water-flowing mechanism further comprises a lifting beam that contacts for fixation with the dust-collecting plate, and a spacer that forms a gap, through which the washing liquid flows, at the contact portion between the dust-collecting plate and the lifting beam.

4. A water-flowing mechanism of a wet electrostatic precipitator according to claim 1, wherein the horizontal cross-sectional face of the dust-collecting plate is formed in a corrugated shape, the lower opening of the cylindrical member is formed in a corrugated shape according to the dust-collecting plate, and the water-flowing mechanism further comprises a lifting beam that contacts for fixation with the dust-collecting plate, a spacer that forms a gap, through which the washing liquid flows, at the contact portion between the dust-collecting plate and the lifting beam, and rectifying means that rectifies the washing liquid, which is supplied to the gap, below the contact portion of the dust-collecting plate and the lifting beam in the gap.

5. A water-flowing mechanism of a wet electrostatic precipitator according to claim 1, wherein the dust-collecting plate is arranged parallel with a flow direction of a gas, and the washing liquid flows on the surface of the dust-collecting plate and in parallel with a plane of the dust-collecting plate.

6. A water-flowing mechanism of a wet electrostatic precipitator according to claim 1, wherein a cross-section shape of the cylindrical member is longer in a vertical direction than in a horizontal direction.

7. A water-flowing mechanism of a wet type electrostatic precipitator comprising:

a dust-collecting plate;

a cylindrical member that is arranged according to the shape of the upper end face of the dust-collecting plate and has an open lower part and an inner surface, the inner surface of a lower part of the cylindrical member being downwardly inclined toward the dust-collecting plate; and a spray nozzle that is arranged in the cylindrical member and injects washing liquid toward the ceiling surface of the cylindrical member such that the washing liquid falls along an inner wall of the cylindrical member and exits from the open lower part to wet the dust-collecting plate.

8. A water-flowing mechanism of a wet electrostatic precipitator according to claim 7, wherein the horizontal cross-sectional face of the dust-collecting plate is formed in a corrugated shape, and the lower opening of the cylindrical member is formed in a corrugated shape according to the dust-collecting plate.

9. A water-flowing mechanism of a wet electrostatic precipitator according to claim 7, wherein the horizontal cross-sectional face of the dust-collecting plate is formed in a corrugated shape, the lower opening of the cylindrical member is formed in a corrugated shape according to the dust-collecting plate, and the water-flowing mechanism further comprises a lifting beam that contacts for fixation with the dust-collecting plate, and a spacer that forms a gap, through which the washing liquid flows, at the contact portion between the dust-collecting plate and the lifting beam.

10. A water-flowing mechanism of a wet electrostatic precipitator according to claim 7, wherein the horizontal cross-sectional face of the dust-collecting plate is formed in a corrugated shape, the lower opening of the cylindrical member is formed in a corrugated shape according to the dust-collecting plate, and the water-flowing mechanism further comprises a lifting beam that contacts for fixation with the dust-collecting plate, a spacer that forms a gap, through which the washing liquid flows, at the contact portion between the dust-collecting plate and the lifting beam, and rectifying means that rectifies the washing liquid, which is supplied to the gap, below the contact portion of the dust-collecting plate and the lifting beam in the gap.

11. A water-flowing mechanism of a wet electrostatic precipitator according to claim 7, wherein the dust-collecting plate is arranged parallel with a flow direction of a gas, and the washing liquid flows on the surface of the dust-collecting plate and in parallel with a plane of the dust-collecting plate.

12. A water-flowing mechanism of a wet electrostatic precipitator according to claim 7, wherein a cross-section shape of the cylindrical member is longer in a vertical direction than in a horizontal direction.

* * * * *